US006324839B1

(12) United States Patent
Canini et al.

(10) Patent No.: US 6,324,839 B1
(45) Date of Patent: Dec. 4, 2001

(54) EXHAUST MANIFOLD FOR INTERNAL COMBUSTION ENGINES

(75) Inventors: Claudio Canini, Drancy; Philippe Lasry, Paris, both of (FR)

(73) Assignee: Renault, Billancourt (FR)

( * ) Notice: Subject to any disclaimer, the term of this patent is extended or adjusted under 35 U.S.C. 154(b) by 0 days.

(21) Appl. No.: 09/646,900

(22) PCT Filed: Apr. 9, 1999

(86) PCT No.: PCT/FR99/00823

§ 371 Date: Dec. 26, 2000

§ 102(e) Date: Dec. 26, 2000

(87) PCT Pub. No.: WO99/53177

PCT Pub. Date: Oct. 21, 1999

(30) Foreign Application Priority Data

Apr. 9, 1998 (FR) ..... 98 04472

(51) Int. Cl.[7] ..... F01N 7/10
(52) U.S. Cl. ..... 60/323; 60/324
(58) Field of Search ..... 60/272, 323, 324

(56) References Cited

U.S. PATENT DOCUMENTS 2,849,858 * 9/1958 Rohrbacher et al. ..... 60/323
4,067,192 * 1/1978 Yamazaki et al. ..... 60/323
4,372,112 * 2/1983 Ackerman et al. ..... 60/323
5,349,817 * 9/1994 Bekkering ..... 60/323
5,572,868 * 11/1996 Okamoto et al. ..... 60/323
5,953,912 * 9/1999 Kaiho et al. ..... 60/323

FOREIGN PATENT DOCUMENTS

3815408 * 12/1988 (DE) .
4315086 * 11/1994 (DE) .
58-51214 * 3/1983 (JP) .
09-025841 * 1/1997 (JP) .

* cited by examiner

*Primary Examiner*—Thomas Denion
*Assistant Examiner*—Tu M. Nguyen
(74) *Attorney, Agent, or Firm*—Oblon, Spivak, McClelland, Maier & Neustadt, P.C.

(57) ABSTRACT

An exhaust manifold which includes a flange to be fixed on an engine cylinder head. A wide exhaust gas collecting cavity is connected to the flange to receive exhaust gases discharged by exhaust pipes of the cylinder head. The wide collecting cavity has a recessed wall element subdividing the cavity into two mutually communicating sub-cavities. An end portion is connected to the collecting cavity outlet and has a discharge outlet for the exhaust gases.

9 Claims, 3 Drawing Sheets

EXHAUST MANIFOLD FOR INTERNAL COMBUSTION ENGINES

BACKGROUND OF THE INVENTION

Field of the Invention

The invention relates to exhaust manifolds for internal combustion engines, and more particularly to those installed in internal combustion engines in association with a means for cleaning the exhaust gases, in particular a start catalyst, which for example is mounted on the manifold.

SUMMARY OF THE INVENTION

One object of the invention is to provide such a manifold whose heat loss is as small as possible in order to shorten the time for starting the cleaning means.

Another object of the invention is to ensure that the gas velocity field over the inlet face of the cleaning means is as uniform as possible.

Yet another object of the invention is to permit easy assembly of the manifold in the factory.

The invention therefore provides an exhaust manifold for internal combustion engines. According to one general characteristic of the invention, this manifold comprises a flange for fixation on the engine cylinder head, a wide exhaust-gas collecting cavity joined to the flange to receive the exhaust gases delivered by the cylinder head exhaust pipes, this wide collecting cavity having a reentrant wall element subdividing the said cavity into two mutually communicating sub-cavities. The manifold also comprises an end portion joined to the collecting cavity outlet and having an outlet orifice for the exhaust gases.

The combination of the "plenum" form of the manifold (wide exhaust-gas collecting cavity) subdivided into two "lungs" ensures that the heat loss will be minimal and contributes to achieving a uniform velocity field and uniform distribution of the exhaust gases at the inlet of a gas cleaning means.

According to one embodiment of the invention, the reentrant wall element provides, on the outside surface of the collecting cavity, a central indentation extending substantially perpendicular to the flange fixation plane, the two sub-cavities being symmetric with respect to the central plane of this central indentation.

This embodiment thus not only makes it possible easily to construct the wide cavity formed by these two lungs but also permits, by virtue of the central indentation, easy introduction of a wrench for establishing a point for fixation of the manifold on the cylinder head.

The wide collecting cavity has an appropriate internal volume. More particularly, it has been found that it is advantageous for the volume of the collecting cavity to be greater than about 0.8 times the cubic capacity of the engine in order to achieve a noteworthy reduction of heat loss as well as good uniformity of the velocity field at the inlet of the cleaning means. In addition, and especially for reasons of overall size, it is preferable that the volume of the collecting cavity be smaller than about 1.5 times the cubic capacity of the engine.

According to a preferred embodiment of the invention, the volume of the collecting cavity is chosen substantially equal to the cubic capacity of the engine, thus permitting an optimal compromise between the criteria of heat loss and uniformity of the velocity field and distribution, and overall manifold size.

It is also particularly advantageous for the end portion to have substantially the form of a bowl, thus permitting the uniformity of the velocity field to be further improved.

In addition, the end portion is preferably provided with an elliptical throttle plate, the major axis of the ellipse being parallel to the plane of fixation of the fixation flange. This also contributes to obtaining better uniformity of the velocity field.

The fixation flange is advantageously provided with four inlet ports to receive the exhaust gases and with five points of fixation on the cylinder head, those points being disposed in crisscross arrangement around the four inlet ports. Furthermore, the line segment connecting the respective centers of two consecutive fixation zones passes substantially through the center of the port situated between these two fixation zones.

Such an embodiment makes it possible to minimize the number of bolts for fixation of the manifold on the cylinder head and thus to minimize the assembly stresses associated with the introduction of wrenches. In addition, the crisscross disposition of the fixation bolts relative to the centers of two consecutive fixation zones aligned with the center of the inlet port situated between these two fixation zones contributes to ensuring excellent leaktightness of fixation of the manifold on the cylinder head.

According to another embodiment of the invention, the manifold also comprises an intermediate connecting portion which connects the fixation flange to the collecting cavity and is provided with exhaust conduits joined respectively to the inlet ports of the fixation flange. Advantageously, the exhaust conduits disposed at the ends of the intermediate connecting portion are convergent. Consequently, all the exhaust conduits make it possible to force the exhaust-gas streams toward the manifold center, thus additionally contributing to achievement of a uniform velocity field over the inlet face of the cleaning means. In addition, this intermediate connecting portion contributes to increasing the rigidity of the manifold.

BRIEF DESCRIPTION OF THE DRAWINGS

Other advantages and characteristics of the invention will become evident upon examination of the detailed description of one embodiment, which in no way is limitative, and of the attached drawings, wherein.

DESCRIPTION OF THE PREFERRED EMBODIMENTS

Figure 1:
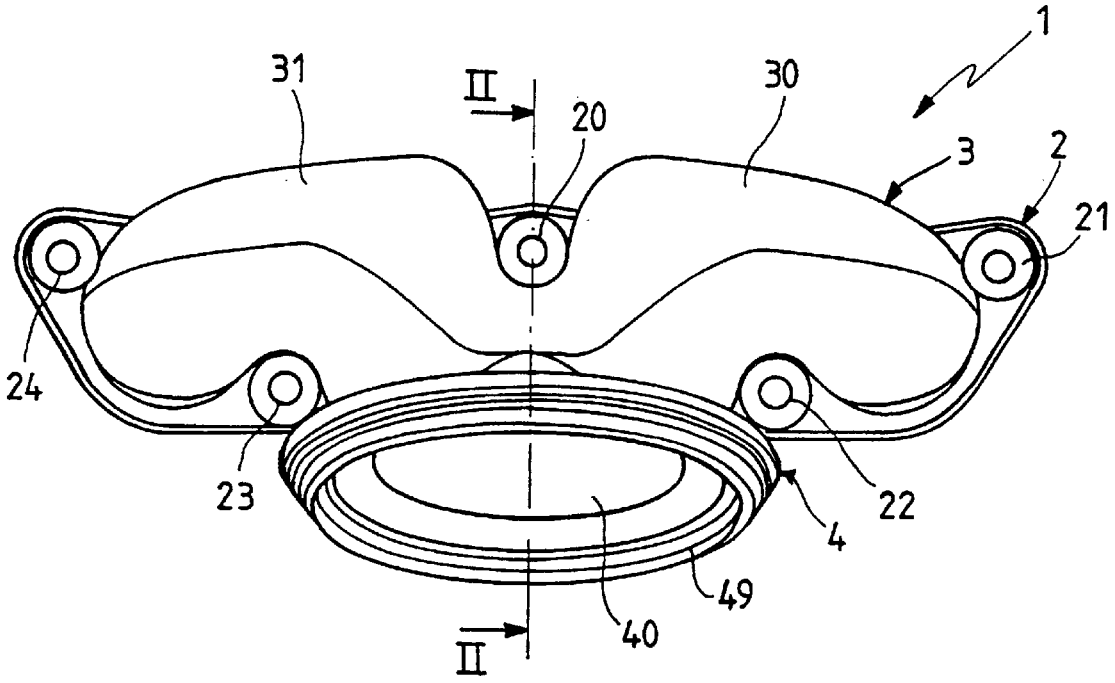
FIG. 1 schematically shows a manifold according to the invention.
Figure 2:
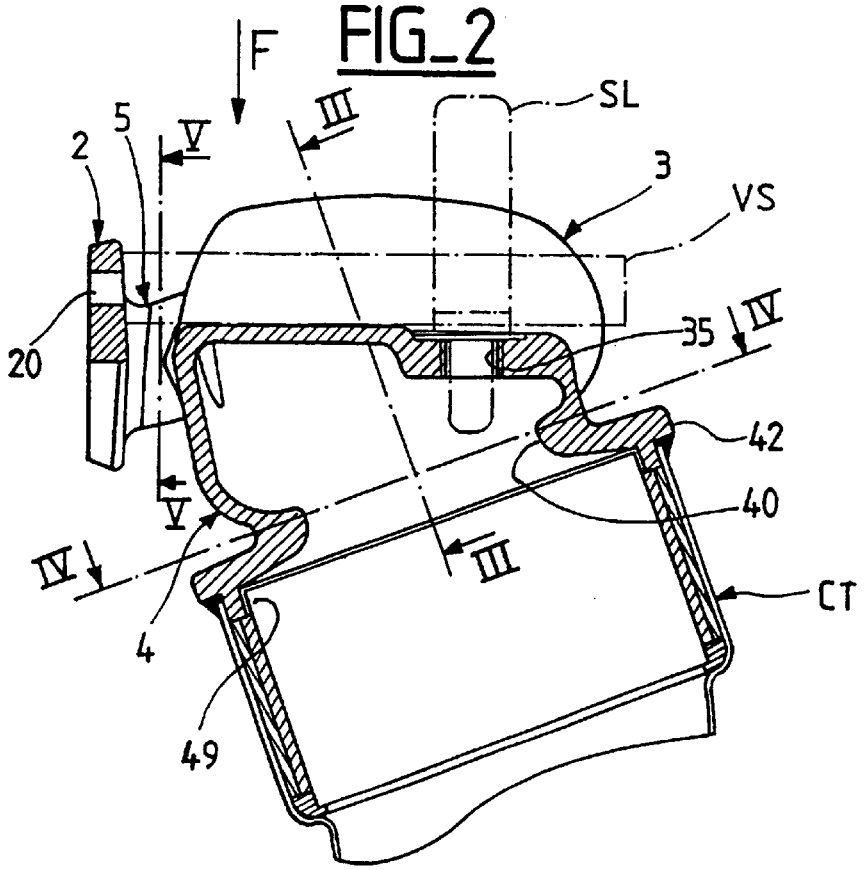
FIG. 2 is a section through line II—II of FIG. 1.

In these FIGS., reference 1 denotes in general an exhaust manifold according to the invention. This manifold is provided with a fixation flange 2 having five fixation holes 20 to 24, by means of which the manifold can be fixed by bolts onto the engine cylinder head.

The manifold is also provided with a wide exhaust-gas collecting cavity 3, which is connected to the fixation flange by an intermediate connecting portion 5.

This wide collecting cavity 3 is prolonged by an end connecting portion 4 provided with a portion 41 having substantially the form of a bowl followed by a fixation flange 42 provided with an exhaust-gas outlet orifice 49, a start catalyst CT being fixed, by welding in the present case, on the said fixation flange.

Figure 4:
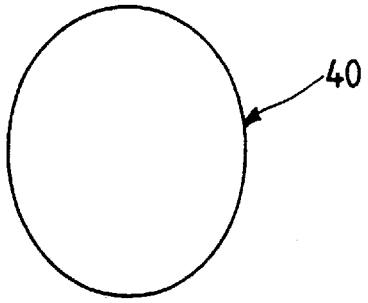
FIG. 4 shows the section of the throttle plate of the manifold through line IV—IV of FIG. 2.

The outlet orifice 40 of bowl 41 is a throttle plate having elliptical section (FIG. 4), the major axis of the ellipse being parallel to the plane of fixation of the manifold on the cylinder head.

Figure 3:
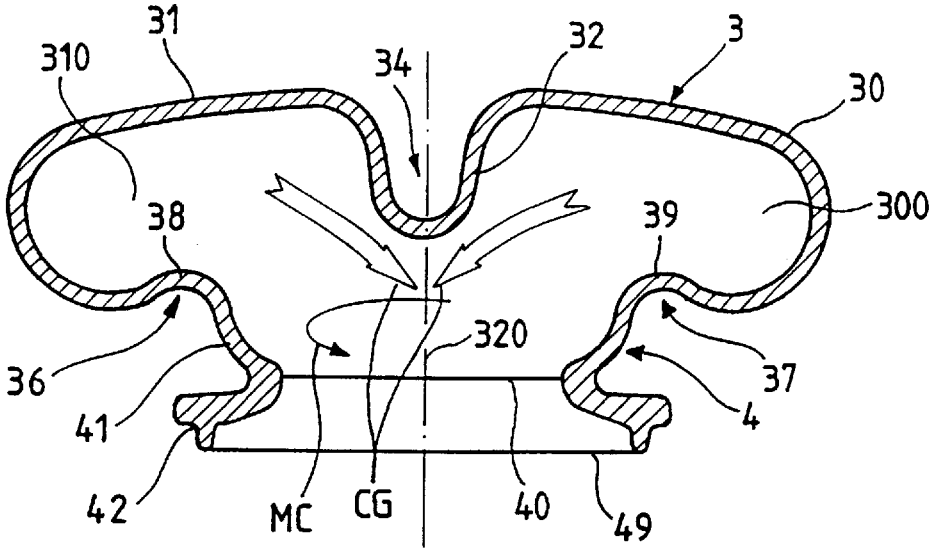
FIG. 3 is a section through line III—III of FIG. 2.

As illustrated more particularly in FIG. 3, the wide exhaust-gas collection cavity 3, which is cast in one piece, supports a reentrant wall element 32, which forms on the outside surface of cavity 3 a central indentation 34, thus creating two symmetric lateral portions 30 and 31. In this way collection cavity 3 is divided into two sub-cavities 300 and 310, which are in mutual communication at the level of constricted section 320 of cavity 3, situated in the plane of symmetry thereof.

Central fixation zone 20 of fixation flange 2 is situated in the extension of central indentation 34, thus permitting introduction of central wrench VS. In addition, lateral portions 30, 31 are provided with reentrant wall elements 39, 38 respectively, which form on the outside surface of these lateral portions two auxiliary indentations 37, 36 respectively.

It will be noted here that fixation zones 22 and 23 are situated respectively in the extension of auxiliary indentations 37 and 36, thus permitting easy introduction of automatic wrenches.

Figure 5:
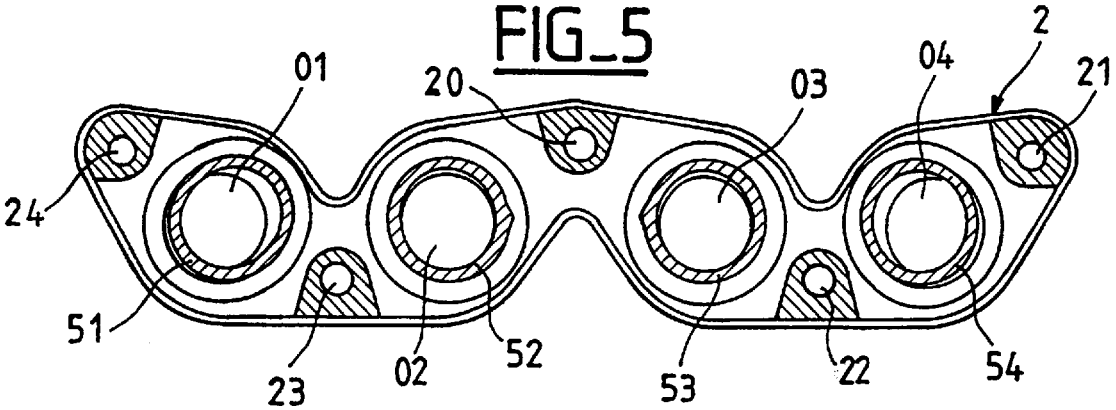
FIG. 5 shows a section through line V—V of FIG. 2.

As illustrated more particularly in FIG. 5, it is evident that fixation flange 2 is provided with four ports O1 to O4 corresponding to the four exhaust pipes made in the cylinder head and joined to the four cylinders of the engine. Fixation holes 20 to 24 are situated in criss-cross pattern around these ports O1 to O4. The center of each inlet port of the fixation flange is substantially aligned with the centers of the two fixation orifices disposed on both sides of this inlet port. Such an arrangement permits the number of manifold fixation bolts to be minimized while at the same time ensuring excellent leaktightness of fixation on the cylinder head.

Figure 6:
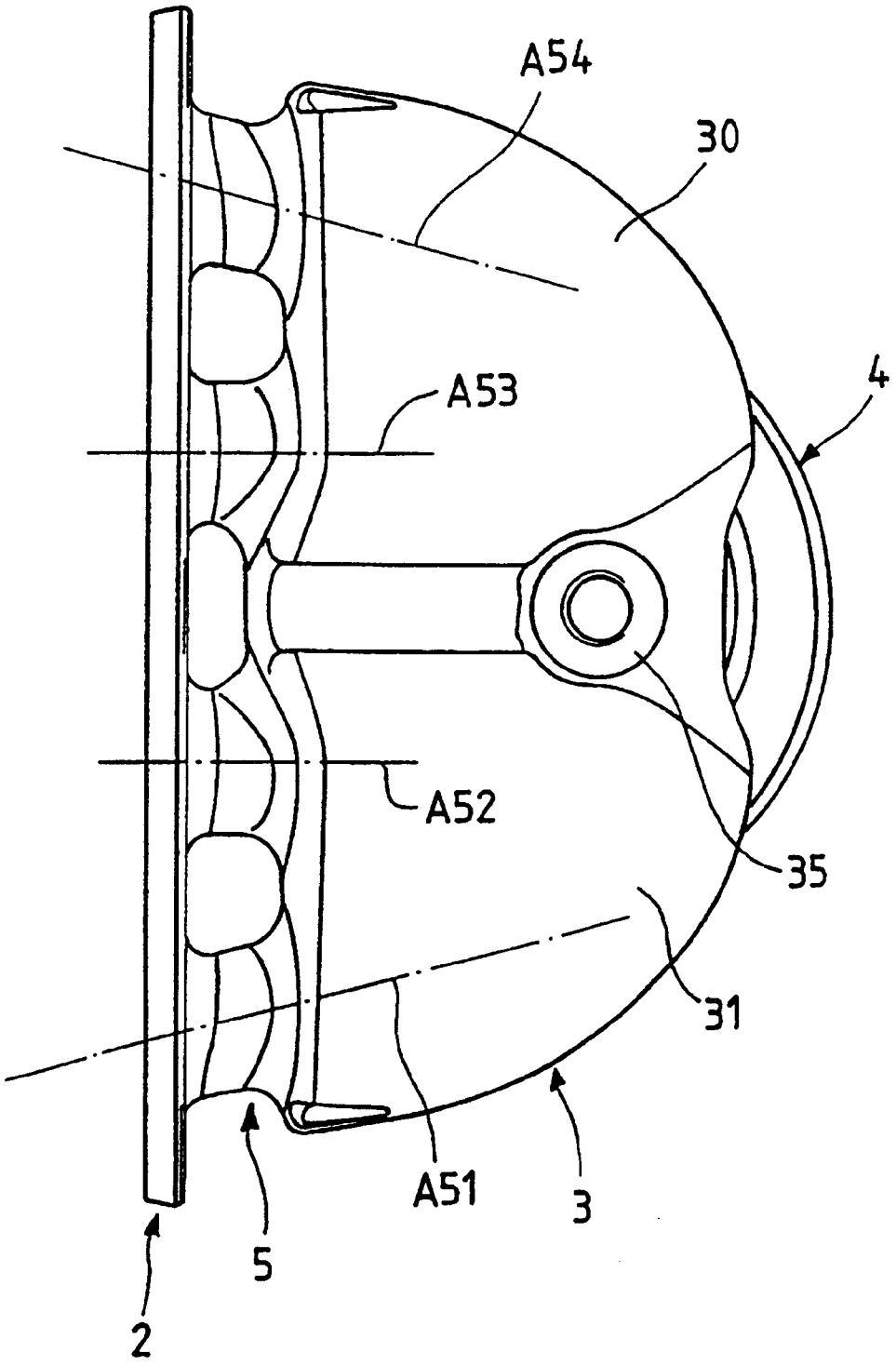
FIG. 6 is a view in the direction of arrow F of FIG. 2.

Intermediate connecting portion 5 is provided with four exhaust conduits 51 to 54 prolonging the exhaust pipes of the cylinder head. As illustrated more particularly in FIG. 6, axes A51 and A54 of the two exhaust conduits situated at the end of intermediate connecting portion 5 converge. Thus the entire group of exhaust conduits 51 to 54, and in particular the two end conduits, ensure that the exhaust-gas streams are forced toward the manifold center.

Finally, at the top of collecting cavity 3, and in the extension of wall element 32 and consequently of central indentation 34, there is disposed a port 35 for housing any desired transducer or sensor, especially a sensor for measuring the oxygen concentration, commonly referred to as "lambda sensor" by those skilled in the art, which sensor is used traditionally in air/fuel ratio control circuits.

The location of this port 35 permits lambda sensor SL to be positioned centrally, which is particularly advantageous.

The invention makes it possible to obtain an exhaust manifold with mounted-on start catalyst, which manifold is particularly efficient as regards heat loss and also as regards uniformity of the velocity field of the gases delivered to the start catalyst. In fact, except for exhaust conduits 51 to 54, which prolong the exhaust pipes for a distance of about 30 mm and incidentally contribute to ensuring good manifold rigidity because of this fact, the pulsations arriving from the four cylinders are collected in a large volume and circulate toward outlet orifice 40 of the bowl as illustrated by arrows CG in FIG. 3. In addition, bowl 41 permits even better homogenization of the gases, especially by causing vortexing action MC (FIG. 3) of the gases, this bowl followed by elliptical throttle plate 40 contributing to the creation of a uniform velocity field at the inlet of the start catalyst.

It will be understood that the invention as described hereinabove is not limited to an exhaust manifold equipped with a mounted-on start catalyst, but that it is also suitable for any gas cleaning means, such as a three-way catalyst, a particulate filter, an $NO_x$ trap, an $SO_x$ trap, etc., whether it is mounted on the manifold or effectively connected thereto by, for example, a tube portion.

What is claimed is:

1. An exhaust manifold for internal combustion engines, characterized in that it comprises a flange for fixation on the engine cylinder head, a wide exhaust-gas collecting cavity joined to the flange to receive the exhaust gases delivered by the cylinder head exhaust pipes, this wide collecting cavity having a reentrant wall element subdividing the said cavity into two mutually communicating sub-cavities, as well as an end portion joined to the collecting cavity outlet and having an outlet orifice for the exhaust gases, wherein each sub-cavity is provided with an auxiliary reentrant wall element, which forms on an outside surface of the corresponding sub-cavity an auxiliary indentation, and wherein two of flange fixation zones are situated respectively in the extensions of the two auxiliary indentations.

2. A manifold according to claim 1, characterized in that the volume of the collecting cavity is greater than about 0.8 times the cubic capacity of the engine and smaller than about 1.5 times the cubic capacity of the engine.

3. A manifold according to claim 1, characterized in that the end portion is provided with a zone having substantially the form of a bowl.

4. A manifold according to claim 1, characterized in that the end portion is provided with a throttle plate of elliptical section, the major axis of the ellipse being parallel to the plane of fixation of the fixation flange.

5. A manifold according to claim 1, characterized in that the fixation flange is provided with four inlet ports to receive the exhaust gases and with five zones of fixation on the cylinder head, the said zones being disposed in criss-cross arrangement around the four inlet ports, and in that the line segment connecting the respective centers of two consecutive fixation zones passes substantially through the center of the port situated between these two fixation zones.

6. A manifold according to claim 1, characterized in that the fixation flange is provided with inlet ports to receive the exhaust gases, in that the manifold also comprises an intermediate connecting portion which connects the fixation flange to the collecting cavity and is provided with exhaust conduits joined respectively to the inlet ports, and in that the exhaust conduits disposed at the ends of the intermediate connecting portion are convergent.

7. A manifold according to claim 1, characterized in that the collecting cavity is provided with an additional port for housing a sensor, disposed in the extension of the wall element.

8. A manifold according to claim 1, characterized in that the reentrant wall element provides, on the outside surface of the collecting cavity, a central indentation extending substantially perpendicular to the flange fixation plane, and in that the two sub-cavities, are symmetric with respect to the central plane of this central indentation.

9. A manifold according to claim 8, characterized in that a central fixation zone of the fixation flange is situated in the extension of the central indentation.

* * * * *